US005445231A

United States Patent [19]

Scott et al.

[11] Patent Number: 5,445,231

[45] Date of Patent: Aug. 29, 1995

[54] EARTH-BURNING BIT HAVING AN IMPROVED HARD-FACED TOOTH STRUCTURE

[75] Inventors: Danny E. Scott; Mou-Chih Lu; Rudolf C. O. Pessier, all of Houston, Tex.

[73] Assignee: Baker Hughes Incorporated, Houston, Tex.

[21] Appl. No.: 279,583

[22] Filed: Jul. 25, 1994

[51] Int. Cl.[6] ..... E21B 10/16; E21B 10/50

[52] U.S. Cl. ..... 175/374; 175/426

[58] Field of Search ..... 175/374, 379, 425, 426

[56] References Cited

U.S. PATENT DOCUMENTS

| | | | |
|---|---|---|---|
| 2,058,753 | 10/1936 | Zublin | 76/108 |
| 2,244,617 | 6/1941 | Hannum | 175/246 |
| 2,660,405 | 11/1953 | Scott et al. | 255/347 |
| 2,687,875 | 8/1954 | Morlan et al. | 175/374 |
| 3,800,891 | 4/1974 | White et al. | 175/374 |
| 4,262,761 | 4/1981 | Crow | 175/374 |
| 4,276,946 | 7/1981 | Millsapps, Jr. | 175/228 |
| 4,630,692 | 12/1986 | Ecer | 175/330 |
| 5,152,194 | 10/1992 | Kesharam et al. | 76/108.2 |
| 5,351,769 | 10/1994 | Scott et al. | 175/374 |

FOREIGN PATENT DOCUMENTS

| | | | |
|---|---|---|---|
| 266990 | 12/1963 | Australia | 175/374 |

*Primary Examiner*—Hoang C. Dang

*Attorney, Agent, or Firm*—Robert A. Felsman; Mark D. Perdue

[57] ABSTRACT

An earth-boring bit has a bit body, at least one cutter rotatably secured to the bit body and including a plurality of teeth formed integrally with the cutter and arranged in circumferential rows thereon. A pair of ribs is formed on at least one of the flanks of at least one of the teeth. The ribs are spaced apart to define a central depression therebetween extending through the crest of the tooth. A thickness of wear-resistant material fills the depression. According to a preferred embodiment of the present invention, wear-resistant material is applied over the ribs, crest, and a portion of the ends and flanks of the tooth, wherein the thickness of the wear-resistant material over the depressions greater, preferably ⅛ inch, than that elsewhere on the tooth.

20 Claims, 2 Drawing Sheets

EARTH-BURNING BIT HAVING AN IMPROVED HARD-FACED TOOTH STRUCTURE

BACKGROUND OF THE INVENTION

1. Field of the Invention

The present invention relates generally to the tooth structure of earth-boring bits of the rolling cutter variety. More particularly, the present invention relates to improving the wear-resistance of mill- or steel-tooth earth-boring bits.

2. Background Information

The success of rotary drilling enabled the discovery of deep oil and gas reservoirs. The rotary rock bit was an important invention that made that success possible. Only soft formations could be commercially penetrated with the earlier drag bit, but the original rolling-cone rock bit invented by Howard R. Hughes, U.S. Pat. No. 930,759, drilled the hard caprock at the Spindletop Field, near Beaumont, Tex., with relative ease.

That venerable invention, within the first decade of this century, could drill a scant fraction of the depth and speed of the modern rotary rock bit. If the original Hughes bit drilled for hours, the modern bit drills for days. Bits today often drill over a mile. Many individual improvements have contributed to the impressive overall improvement in the performance of rock bits.

The early rolling-cone earth-boring bits had teeth formed integrally with the cutters. These bits, commonly known as "steel-tooth" or "mill-tooth" bits, are still in common usage for penetrating relatively soft formations. The strength and fracture-toughness of the steel teeth permits relatively long teeth with long crests, which provide the aggressive gouging and scraping action that is advantageous for the rapid penetration of relatively soft formations.

However, it is rare that a formation interval will consist entirely of soft material with low compressive strength. Often, there are streaks of hard or abrasive materials that a steel-tooth bit must be able to penetrate economically and without damage to the bit.

Although steel teeth possess good strength, their abrasion resistance generally is not adequate to permit rapid penetration of hard or abrasive streaks without damage to the bit. Consequently, it is conventional in the art to provide a layer of wear-resistant material or hard-facing over at least a portion of the teeth of a steel tooth bit. These wear-resistant materials or hard-facings are conventional, and typically consist of particles of tungsten carbide or other hard metal dispersed in a steel, nickel, or cobalt binder matrix. Such hard-facing materials are applied by melting the binder of the hard-facing material and applying the material over the surfaces of the tooth. The proper application of hard-facing material to steel tooth bits requires considerable skill on the part of the welder.

The practice of hard-facing steel teeth was initiated in approximately 1929. With the introduction of the tungsten carbide insert (TCI) bit by Hughes Tool Company in the 1950's (see U.S. Pat. No. 2,687,875, Aug. 31, 1954, to Morlan, et al.), the focus of the drilling industry research turned to the use of TCI bits. More recently, attention again has focused on the improvement and development of earth-boring bits of the milled steel-tooth variety because of advances in bearing and seal technology.

It is difficult to apply a relatively thick layer of hard-facing material over the crest or ends of teeth within tolerance. A tooth with a crest hard-faced to a thickness beyond the tolerance can cause the tooth to interfere with or "strike" an opposing cone. This condition requires expensive and time-consuming grinding of the hard-faced crest to reduce the thickness and eliminate interference. At least as early as 1989, one corner of the steel teeth in one row was beveled to permit application of hard-facing without causing the aforementioned interference between teeth.

U.S. Pat. No. 5,152,194, Oct. 6, 1992, to Keshavan, et al. discloses a method of hard-facing a steel-tooth earth-boring bit, wherein a substantially uniform thickness of hard-facing is provided over the tooth. Each corner of each tooth is rounded to achieve uniform hard-facing thickness. That disclosure does not address the difficulty of applying a thick layer of hard-facing material over a tooth of a steel-tooth earth-boring bit without incurring the problem of tooth strike, which requires costly and time-consuming grinding operations to bring the hard-faced tooth within the clearances and tolerances necessary to avoid strike.

U.S. Pat. No. 2,660,405, Nov. 24, 1953 to Scott, et al., which is commonly owned, with this application, discloses a steel-tooth earth-boring bit in which one flank of a tooth is "gashed," or provided with a depression, which is filled with a hard-facing material to provide a self-sharpening tooth structure. The gashes extend from one end of the tooth to the other, which reduces the section modulus of the tooth, thereby weakening the steel tooth and increasing its susceptibility to failure due to bending and compressive loads applied to the crest and flanks of the tooth in drilling operations.

U.S. Pat. No. 2,058,753, Oct. 27, 1936 to Zublin discloses provision of a tooth of a steel-tooth earth-boring bit with a series of shallow grooves formed in the flank of the tooth that do not extend through the crest of the tooth. The metal in the grooves is melted and the grooves are filled with tungsten carbide particles, which are retained on the flank of the tooth when the molten metal in the grooves cools. These grooves cause a less drastic reduction in the strength of the tooth than the gashes proposed by Scott, et al., but do not address increasing the wear-resistance of the crest of the tooth. Moreover, the tooth resulting from the method disclosed by Zublin has tungsten carbide particles dispersed in only a portion of the flank of the tooth, i.e. where the grooves initially were formed.

A need exists, therefore, for an earth-boring bit having hard-faced steel tooth structure that provides improved wear-resistance at the crest, flanks, and ends of the tooth, while maintaining the structural integrity of the underlying steel tooth, as well as the original hard-faced tooth geometry as the tooth wears.

SUMMARY OF THE INVENTION

It is a general object of the present invention to provide an improved earth-boring bit having an improved hard-faced tooth structure.

This and other objects of the present invention are achieved by providing a pair of ribs that are formed on at least one of the flanks of at least one of the teeth. The ribs are spaced apart to define a central depression therebetween extending through the crest of the tooth. A thickness of wear-resistant material fills the depression. According to a preferred embodiment of the present invention, wear-resistant material is applied over the ribs, crest, and a portion of the ends and flanks of the tooth, wherein the thickness of the wear-resistant material over the depressions greater, preferably ⅛ inch, than that elsewhere on the tooth.

According to a preferred embodiment of the present invention, the depression defines a lower surface, a pair of rib surfaces, and a back surface, each of the surfaces being orthogonal to one another. The depression may be filled with a wear-resistant insert secured in the depression and wear-resistant material may be applied over the insert, crest, and at least a portion of the ends and flanks of the tooth.

Other objects, features, and advantages of the present invention will become apparent to those having skill in the art with reference to the drawings and detailed description, which follow.

DESCRIPTION OF THE PREFERRED EMBODIMENT

Figure 1:
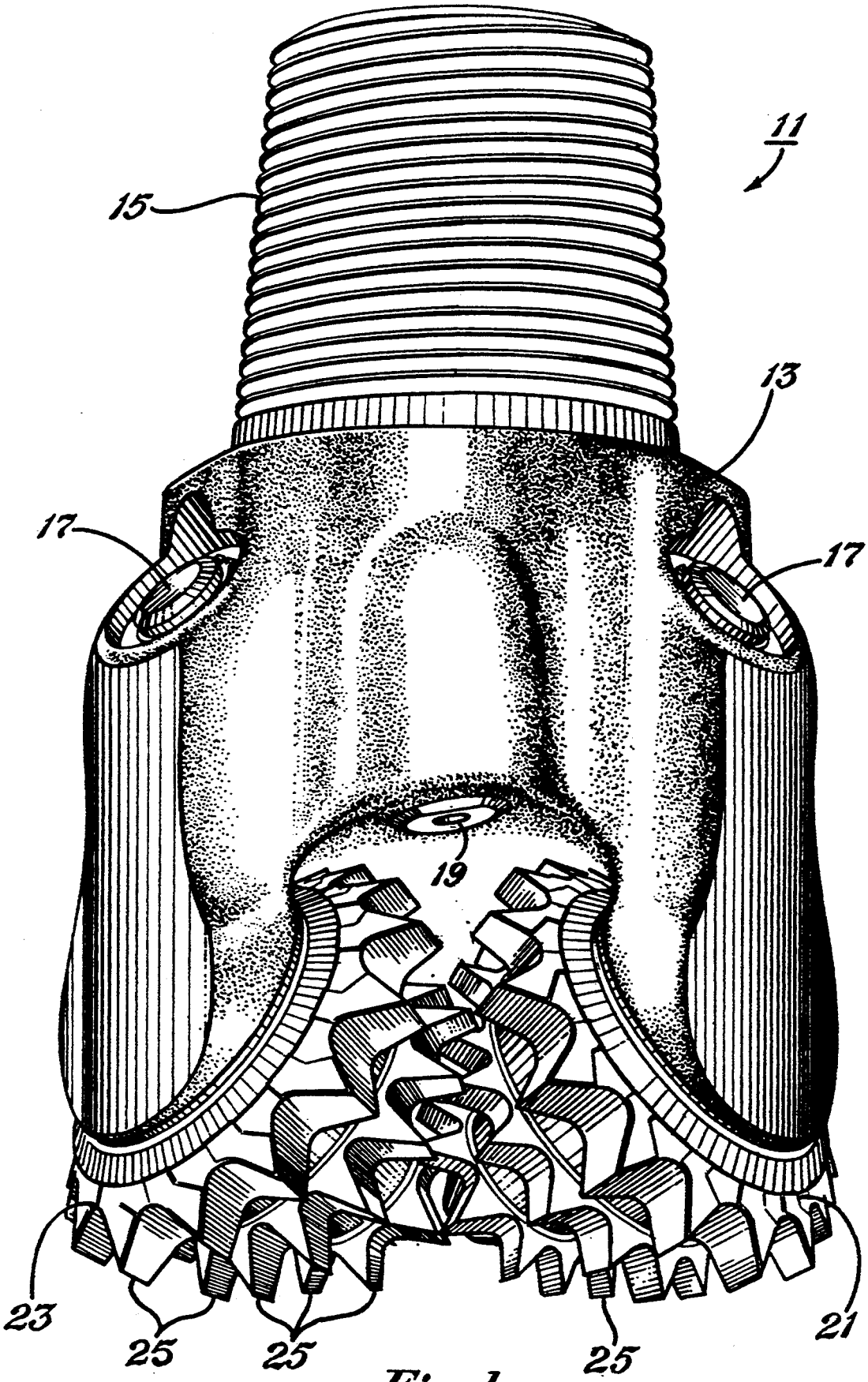
FIG. 1 is a perspective view of an earth-boring bit of the type contemplated by the present invention.

Referring now to FIG. 1, an earth-boring bit 11 according to the present invention is depicted. Earth-boring bit 11 includes a bit body 13 having threads 15 at its upper extent for connecting bit 11 into a drillstring (not shown). Each leg of bit 11 is provided with a lubricant compensator 17, a preferred embodiment of which is disclosed in U.S. Pat. No. 4,276,946, Jul. 7, 1981, to Millsapps. At least one nozzle 19 is provided in bit body 13 for spraying cooling and lubricating drilling fluid from within the drillstring to the bottom of the borehole.

At least one cutter, in this case three (one of which is obscured from view in the perspective of FIG. 1), 21, 23 is rotatably secured to each leg of bit body 13. A plurality of teeth 25 are arranged in generally circumferential rows on cutters 21, 23. Teeth 25 are integrally formed from the material of cutters 21, 23, which is usually steel.

Figure 2:
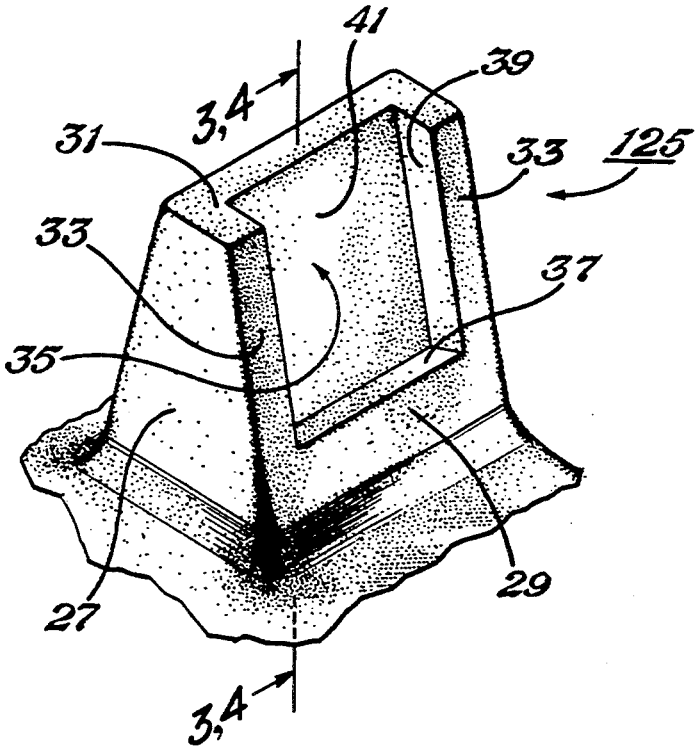
FIG. 2 is a perspective, fragmentary view of a steel tooth of an earth-boring bit according to the present invention.

FIG. 2 is a perspective view of a tooth 25 formed according to the present invention. Tooth 25 includes a pair of ends 27 and a pair of flanks 29 (one flank and one crest are obscured from view in the perspective of FIG. 2). A crest 31 substantially transversely connects ends 27 and flanks 29.

A pair of ribs 33 are formed on at least one of flanks 29 and extend through crest 31 of tooth 25, and are spaced apart, adjacent ends 27 of tooth 25, to define a central depression 35 therebetween. Preferably, central depression 35 is polyhedral in configuration and defines a lower surface 37, a pair of rib surfaces 39, and a back surface 41, each of these surfaces being orthogonal relative to one another. Thus, any section taken of tooth 25 parallel to crest 31 will reveal a U beam geometry, which provides an enhanced section modulus and increased resistance to bending and compressive stresses.

Figure 3:
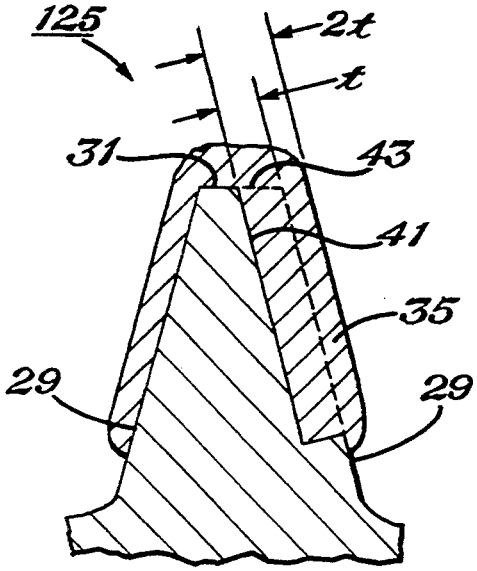
FIG. 3 is a fragmentary section view of a steel tooth of an earth-boring bit according to the present invention.
Figure 4:
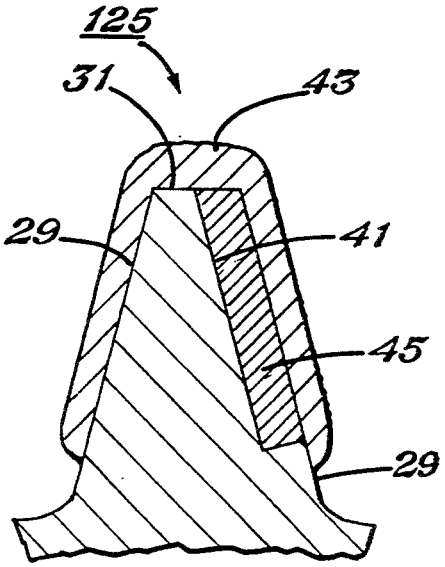
FIG. 4 is a fragmentary section view of a steel tooth of an earth-boring bit according to the present invention.

FIGS. 3 and 4 are longitudinal section views of tooth 25 according to the present invention, wherein a thickness of wear-resistant material 43 fills depression 35 and is applied over ribs 33, crest 31 and at least a portion of ends 27 and flanks 29. In FIG. 3, thickness of wear-resistant material 43 is hard-facing material. Hard-facing materials are conventional and generally consist of particles of tungsten carbide or other hard metal dispersed in a matrix of nickel, cobalt, steel, or an alloy thereof. Hard-facing materials generally are applied by melting the matrix and applying the hard-facing over tooth 25 using a gas torch.

Because of central depression 35, the thickness of wear-resistant material 43 over one of flanks 29 is substantially greater than that over the remainder of tooth 25. This increased thickness extends through crest 31 of tooth 25, providing increased wear-resistance at crest 31. According to a preferred embodiment of the present invention, the depth of central depression 35 is selected to be equal to the thickness t of the layer of wear-resistant material 43 applied over the remainder of tooth 25. This results in a thickness $2t$ over depression 35 and flank 29 that is substantially twice the thickness t of wear-resistant material over the remainder of tooth 25. Preferably, thickness $2t$ over depression 35 and flank 29 is 0.125 or ⅛ inch, thickness t of wear-resistant material 43 over the remainder of the tooth being 0.063 or 1/16 inch.

According to an embodiment of the present invention, the wear-resistant material on one of the flanks 29 has a hardness and wear resistance different from that on the other of flanks 29. This renders tooth 25 self-sharpening because the differential in the wear rates of flanks 29 maintains a sharp, well-defined crest 31. The difference in hardness between the material on flanks 29 and the increased thickness of the harder material combine to increase the self-sharpening effect.

FIG. 4 illustrates an embodiment of the present invention in which depression 35 is filled with a wear-resistant insert 45. Insert 45 is formed of a cemented carbide material, such as that disclosed in commonly assigned U.S. Pat. No. 5,281,260 to Kumar et al. Insert 45 is preferably a monolithic body dimensioned to be coextensive with depression 35 and is secured therein by brazing, soldering, or other conventional processes. A thickness of wear-resistant material 43 in the form of hard-facing preferably is applied over depression 35, crest 31, and a portion of ends 27 and flanks 29 of tooth 25.

With reference to FIGS. 1–4, the operation of earth-boring bit 11 according to the present invention will be described. Bit 11 is connected by threads 15 into a drillstring (not shown). Drillstring and bit 11 then are rotated, wherein cutters 21, 23 roll and slide over the bottom of the borehole. As cutters 21, 23 roll and slide over the bottom of the borehole, teeth 25 gouge and scrape formation material, resulting in penetration of the formation. Drilling fluid from within drillstring exits nozzle 19, cooling and lubricating cutters 21, 23, and lifting fragments of formation material away from the bottom of the borehole.

Improved teeth 25 remain sharp because of their improved 32 wear resistance, which results from increased thickness $2t$ of 33 wear-resistant material 43 over selected portions of tooth 25.

A principal advantage of the present invention is the provision of an earth-boring bit having improved wear resistance without sacrificing efficient, sharp tooth geometry and the resulting increased rate of penetration of bit. In addition to improved wear resistance, the tooth of the earth-boring bit according to the present invention possess greater strength because a U beam geometry is preserved in the underlying steel tooth. As the tooth wears, the increased thickness of wear-resistant material on one flank permits the tooth to maintain a sharp, well-defined crest rather than become blunt as with conventional teeth.

While the invention has been shown in only one of its preferred embodiments, it is thus not limited. It will be apparent to those having skill in the art that the present invention is subject to variation and modification without departure from the scope thereof.

We claim:

1. An improved earth-boring bit comprising:

a bit body;

at least one cutter rotatably secured to the bit body, the cutter including a plurality of teeth formed integrally with the cutter and arranged in circumferential rows on the cutter, each tooth having a pair of ends, a pair of flanks, and a crest substantially transversely connecting the ends and flanks;

a pair of ribs formed on at least one of the flanks of at least one of the teeth, the ribs being spaced apart to define a central depression therebetween in the flank of the tooth, the depression extending through the crest of the tooth; and a thickness of wear-resistant material generally filling the depression and applied over the ribs, the crest, and a portion of the ends and flanks of the tooth, the thickness of the wear-resistant material over the depression being substantially greater than elsewhere on the at least one tooth.

2. The improved earth-boring bit according to claim 1 wherein the wear-resistant material over the flank having the ribs and depression has an abrasion resistance substantially different from that over the other flank.

3. The improved earth-boring bit according to claim 1 wherein the depression defines a lower surface, a pair of rib surfaces, and a back surface, the surfaces being orthogonal to one another.

4. The improved earth-boring bit according to claim 1 wherein the thickness of the wear-resistant material over and filling the depression is ⅛ inch.

5. The improved earth-boring bit according to claim 1 wherein each of the teeth in a circumferential row of teeth is provided with the ribs and depression.

6. The improved earth-boring bit according to claim 1 wherein the wear-resistant material comprises:

a solid wear-resistant insert secured in the depression; and a hardfacing material applied over the wear-resistant insert, the ribs, the crest, and at least a portion of the ends and flanks.

7. An improved earth-boring bit comprising:

a bit body;

at least one cutter rotatably secured to the bit body, the cutter including a plurality of teeth formed integrally with the cutter and arranged in circumferential rows on the cutter, each tooth having a pair of ends, a pair of flanks, a base, and a crest substantially transversely connecting the ends and flanks;

a pair of ribs formed on at least one of the flanks of at least one of the plurality of teeth, each of the pair of ribs being disposed adjacent one end of the tooth and extending from a point along the flank proximal to the base of the tooth through the crest of the tooth, the pair of ribs defining a depression in the flank; and a thickness of wear-resistant material filling the depression and applied over at least the ribs, the crest and a portion of the ends and flanks of the at least one of the plurality of teeth, the thickness of the wear-resistant material over the depression being substantially two times greater than elsewhere on the at least one tooth to provide a more wear-resistant tooth.

8. The improved earth-boring bit according to claim 7 wherein the thickness of the wear-resistant material over the depression is ⅛ inch thick.

9. The improved earth-boring bit according to claim 7 wherein each of the teeth in at least one circumferential row is provided with the ribs and the depression.

10. The improved earth-boring bit according to claim 7 wherein the wear-resistant material over the flank having the ribs and depression has an abrasion resistance substantially different from that over the other flank.

11. The improved earth-boring bit according to claim 7 wherein the depression defines a lower surface, a pair of rib surfaces, and a back surface, the surfaces being orthogonal to one another.

12. The improved earth-boring bit according to claim 7 wherein the wear-resistant material comprises:

a solid wear-resistant insert secured in the depression; and a hardfacing material applied over the wear-resistant insert, the ribs, the crest, and at least a portion of the flanks and ends.

13. An improved earth-boring bit comprising:

a bit body;

at least one cutter rotatably secured to the bit body, the cutter including a plurality of teeth machined from the material of the cutter and arranged in circumferential rows on the cutter, each tooth having a pair of ends, a pair of flanks, and a crest substantially transversely connecting the ends and flanks;

a pair of ribs formed on the flank of at least one of the teeth in one circumferential row, each rib adjacent one end of the tooth and extending from the crest to a point along the flank proximal to the base of the tooth;

a central depression defined in the flank between the ribs and extending through the crest, the depression defining a lower surface, a pair of rib surfaces, and a back surface, the surfaces being orthogonal to one another; and a thickness of wear-resistant material filling the depression and applied over at least the ribs, the crest, and a portion of the ends and flanks of each tooth, wherein the thickness of the wear-resistant material over the depression is substantially not less than ⅛ inch.

14. The improved earth-boring bit according to claim 13 wherein the wear-resistant material over the flank having the depression and ribs has an abrasion-resistance substantially different from that over the other flank.

15. The improved earth-boring bit according to claim 13 wherein the wear-resistant material comprises:

a solid wear-resistant insert secured in the depression; and a hardfacing material applied over the wear-resistant insert and the ribs, the crest, and at least a portion of the crest and flanks.

16. The improved earth-boring bit according to claim 13 wherein the wear-resistant material comprises:

a wear-resistant insert generally coextensive with and secured in the depression; and a hardfacing material applied over the insert and the ribs, the crest, and at least a portion of the ends and flanks.

17. An improved earth-boring bit comprising:

a bit body;

at least one cutter rotatably secured to the bit body, the cutter including a plurality of teeth machined from the material of the cutter and arranged in circumferential rows on the cutter, each tooth having a pair of ends, a pair of flanks, and a crest substantially transversely connecting the ends and flanks;

a pair of ribs formed on the flank of at least one of the teeth in one circumferential row, each rib adjacent one end of the tooth and extending from the crest to a point along the flank proximal to the base of the tooth;

a central depression defined in the flank between the ribs and extending through the crest; and at least one wear-resistant insert secured in and substantially filling the depression.

18. The improved earth-boring bit according to claim 17 wherein a wear resistant material is applied over the insert, the ribs, the crest, and at least a portion of the ends and flanks of the tooth.

19. The improved earth-boring bit according to claim 18 wherein the combined thickness of the wear-resistant insert and the wear-resistant material is $\frac{1}{8}$ inch.

20. The improved earth-boring bit according to claim 17 wherein each of the teeth in a circumferential row is provided with the ribs, depression, and wear-resistant insert.

* * * * *